United States Patent [19]

Hill

[11] 4,450,578

[45] May 22, 1984

[54] VARIABLE APERTURE COLLIMATOR FOR HIGH ENERGY RADIATION

[75] Inventor: Ronald A. Hill, Albuquerque, N. Mex.

[73] Assignee: The United States of America as represented by the United States Department of Energy, Washington, D.C.

[21] Appl. No.: 354,552

[22] Filed: Mar. 3, 1982

[51] Int. Cl.[3] ..... G21F 5/04

[52] U.S. Cl. ..... 378/152; 378/150

[58] Field of Search ..... 378/150, 152; 250/505.1

[56] References Cited

U.S. PATENT DOCUMENTS 2,412,662 12/1946 Watson ..... 378/152

2,836,729 5/1958 Snarr ..... 378/152

*Primary Examiner*—Craig E. Church

*Attorney, Agent, or Firm*—James H. Chafin; Albert Sopp; Michael F. Esposito

[57] ABSTRACT

An apparatus is disclosed providing a variable aperture energy beam collimator. A plurality of beam opaque blocks are in sliding interface edge contact to form a variable aperture. The blocks may be offset at the apex angle to provide a non-equilateral aperture. A plurality of collimator block assemblies may be employed for providing a channel defining a collimated beam. Adjacent assemblies are inverted front-to-back with respect to one another for preventing noncollimated energy from emerging from the apparatus. An adjustment mechanism comprises a cable attached to at least one block and a hand wheel mechanism for operating the cable. The blocks are supported by guide rods engaging slide brackets on the blocks. The guide rods are pivotally connected at each end to intermediate actuators supported on rotatable shafts to change the shape of the aperture. A divergent collimated beam may be obtained by adjusting the apertures of adjacent stages to be unequal.

10 Claims, 9 Drawing Figures

VARIABLE APERTURE COLLIMATOR FOR HIGH ENERGY RADIATION

The U.S. Government has rights in this invention pursuant to Contract No. DE-AC04-76DPOO789 between the U.S. Department of Energy and Western Electric Company. (41CFR Sec. 9-9.109-6(i) (5) (ii) (b)).

BACKGROUND OF THE INVENTION

The present invention relates to the field of energy beam collimators, and more particularly to an apparatus providing an array of movable blocks to define a variable aperture to allow an energy beam to be precisely controlled and directed toward the target.

In using energy beams in general, and neutron beams in particular, especially in therapeutic applications, it is necessary to be able to adjust both the size and the shape of the beam; that is to collimate the beam. At least two basic approaches to varying collimator aperture size are well known. In one technique, individual collimating devices are removed and replaced to provide variations in aperture size and shape. Generally a set of individual collimator devices having mating configurations is used. With this technique, substantial time must be spent in removing and replacing the individual collimator devices. In addition, space must be set aside for storing the individual devices when they are not in use.

A second approach to collimator aperture control is seen in U.S. Pat. No. 3,688,402 to Palermo et al in which an adjustable collimator is disclosed. The collimator is used with an X ray beam and has two web assemblies, one horizontal and one vertical. Each web assembly has a pair of spaced and connected webs forming a continuous loop over a pair of rollers. The size of the aperture is adjusted by rotating the rollers to move the interconnected web to adjust the amount of space between the ends of the webs. In this arrangement, horizontal and vertical beam opaque material overlap or are stacked in certain horizontal and vertical areas, and, as a result, twice as much beam opaque material is present in areas of overlap as compared with areas which are not overlapped. The overlapping is an undersirable and inefficient use of the beam opaque material. Thus, the basic need for a new, more efficient, approach to beam collimation is identified.

Neutrons from ion beam devices and cyclotrons are becoming increasingly important in the treatment of certain types of malignant tumors. Neutron beams, having no charge, cannot be directed and focussed by electrostatic or electromagnetic fields. To protect the patient, the beam must be attenuated and/or blocked in unwanted peripheral areas while being left an unimpeded path in a desired direction to form the desired effective beam. In other words, the beam must be collimated.

Often it is desirable to obtain a collimated beam having either diverging or converging characteristics. In U.S. Pat. No. 3,781,564 to Lundberg a neutron beam collimator providing a divergent collimated beam is disclosed. For variations in divergence characteristics, the Lundberg device requires a plurality of fixed dimension divergent beam collimators. In contrast, it would be desirable to be able to have variably adjustable divergent beam collimation.

SUMMARY OF THE INVENTION

Accordingly, it is a primary object of the present invention to provide a variable aperture energy beam collimator that is easily and rapidly adjustable.

It is another object to provide an adjustable beam collimator that is efficiently operable to provide either a fixed or diverging beam without individually handling beam moderating devices.

Another object of the invention is to provide a variable aperture collimator efficient in the use of beam shielding material by not having overlapping or stacking of the shielding material.

Another object of the invention is to provide a variable aperture collimator capable of easy set-up for defining a divergent collimated beam.

Additional objects, advantages, and the novel features of the invention will be set forth in part in the description that follows and in part will become apparent to those skilled in the art upon examination of the following or may be learned by the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved apparatus is provided for varying the aperture of an energy beam collimator. The invention includes the novel approach of employing an assembly of beam opaque blocks having adjacent edges in interfacial contact. The blocks slide with respect to each other while maintaining the sliding interfaces. When the blocks slidingly separate, an aperture forms for transmittal of the collimated energy beam. When the blocks come together in the closed position, a completely beam-opaque surface results, and no collimated beam is transmitted.

Adjustment means are provided for sliding the blocks with respect to one another thereby providing the selected aperature to define the beam. By use of the invention, rapid adjustments of the collimator are possible without removing and replacing fixed-size collimator devices. In addition, with the apparatus of the invention, the array of blocks in a single block assembly are not stacked or overlapping.

The adjustable blocks converge at apexes adjacent to the center of the block assembly. As to the number of blocks in the block assembly, three, four, six and eight are suitable. Four blocks, however, is the preferred number. In general, there are n blocks in number where n is greater than two. The apex angle of the blocks is equal to 360/n degrees. For four blocks, the apex angle is 90 degrees; for three blocks, 120 degrees; for six blocks, 60 degrees; and for eight blocks, 45 degrees.

In accordance with the invention, the means for adjusting the blocks to provide variable aperture assembly includes a selectively movable cable attached to at least one block; the remaining blocks being followers due to the mechanical pressure transmitted at the sliding interfaces. Block guide rods engage slide brackets on the blocks to restrain the block movement along predetermined paths.

Preferably, the adjusting means further comprises an elongated perforated belt section connected to the cable. The belt section is operated by a drive sprocket driven by a drive wheel assembly having a hand wheel and a worm gear and pinion.

In a further aspect of the invention, in accordance with its objects and purposes, a variable aperture beam collimator is provided wherein the moving means for the guide rods allows for providing a non-equilateral variable aperture. The guide rods are moved toward and away from the center of the block assembly to control the shape of the aperture. For efficient actuation, the ends of the block guide rods are pivotally connected to T-shaped intermediate actuators mounted on rotatable shafts. When the shafts are rotated, the intermediate actuators laterally translate the guide rods causing the blocks to be offset or skewed with respect to one another. In the closed position, regardless of the offset positioning of the blocks, a completely beam-opaque surface is formed thus preventing beam transmission. In the open position, the offset blocks provide the selected, equilateral or non-equilateral collimator aperture.

In still another aspect of the present invention, multiple block assemblies may be provided forming a beam channel for providing additional collimating action for an energy beam. In the preferred embodiment shown, four separate block assemblies defining separate nonequilateral apertures combine to form the beam confining channel. The center axis of the apertures are in alignment and the sides of the apertures are maintained in alignment with each other in all adjusted sizes. Alternate block assemblies are inverted front-to-back with respect to each other. As a result, the contacting edges of the blocks of the second and fourth block assemblies are not in alignment with the contacting edges of the blocks in the first and third block assemblies. This arrangement virtually eliminates the possibility of energy leakage along the edge interfaces. The only energy beam energing from the collimating apparatus is the collimated beam passing through the channel defined by the four apertures.

By adjusting the block assemblies to have increasing size apertures along the channel, a collimated beam that diverges may be readily obtained. The aperture nearer the energy source is smaller with each aperture farther from the energy source being incrementally larger so that the divergent collimated beam is obtained. On the other hand, if desired, apertures nearer the energy source may be increasingly larger and then a partially convergent collimated beam may be obtained.

Still other objects of the present invention will become readily apparent to those skilled in this art from the following description wherein there is shown and described a preferred embodiment of this invention, simply by way of illustration of one of the best modes contemplated for carrying out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE INVENTION

Figure 1:
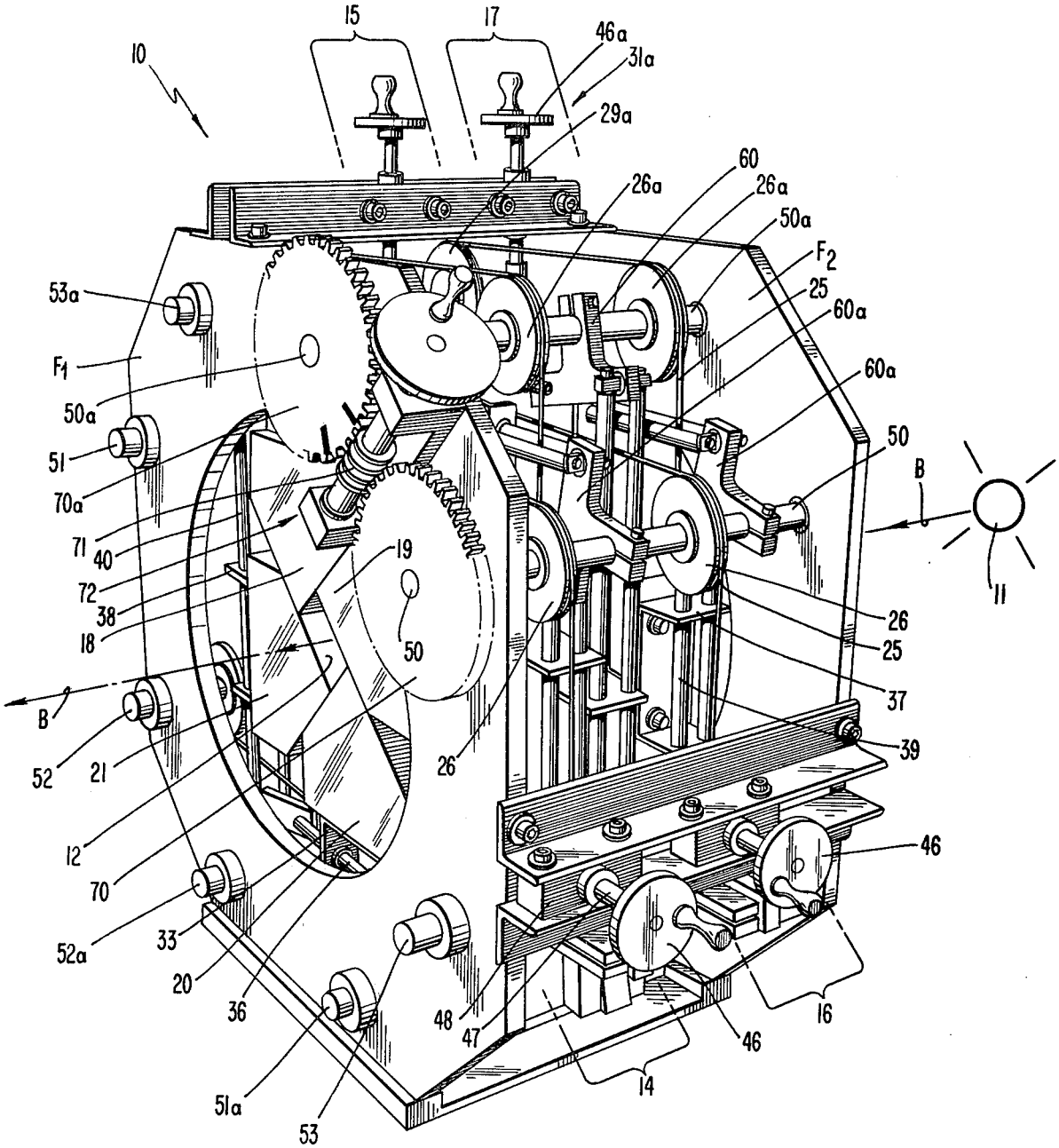
FIG. 1 is a perspective view of a multiple aperture embodiment of the invention forming an elongated channel beam collimator.
Figure 5:
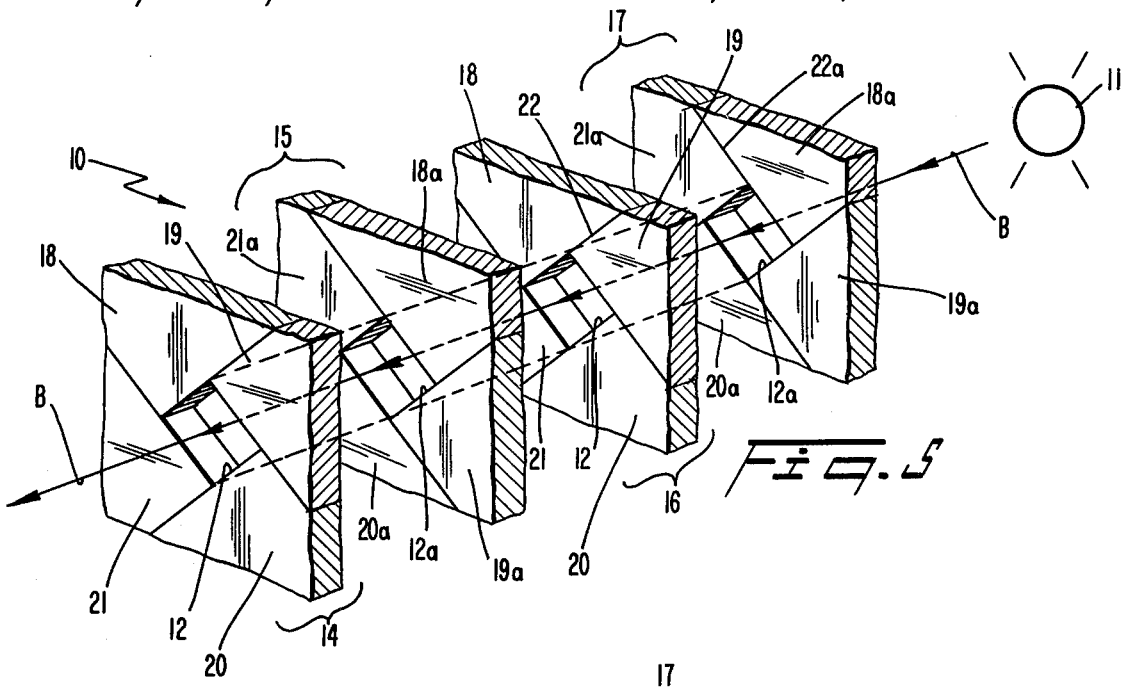
FIG. 5 is a schematic, perspective view of the blocks of the multiple block collimator illustrating a constant size beam channel.

Reference is made to FIGS. 1 and 5 showing a variable aperture beam collimator 10 of the invention utilizing four block assemblies defining a constant size beam channel extending through the collimator. An energy beam source 11, for example a neutron beam source, emits an energy beam B for projection through the aligned apertures 12 of the block assemblies of the collimator of the invention. The beam B projects through the channel in a straight line and emerges from the last in-line aperture 12 as a collimated beam (represented by the arrow B).

The collimator 10, as best seen by viewing FIG. 1 in connection with FIG. 5, includes separate block assemblies 14, 15, 16 and 17. Assemblies 14 and 16 are in congruent relationship, that is physically oriented in the same way, as are assemblies 15 and 17. In particular, assemblies 15 and 17 are inverted front-to-back about axis A with respect to assemblies 14 and 16. This difference in orientation can also be seen by comparing FIGS. 2A and 3A showing the first two in-line assemblies 14, 15, respectively.

Figure 2A:
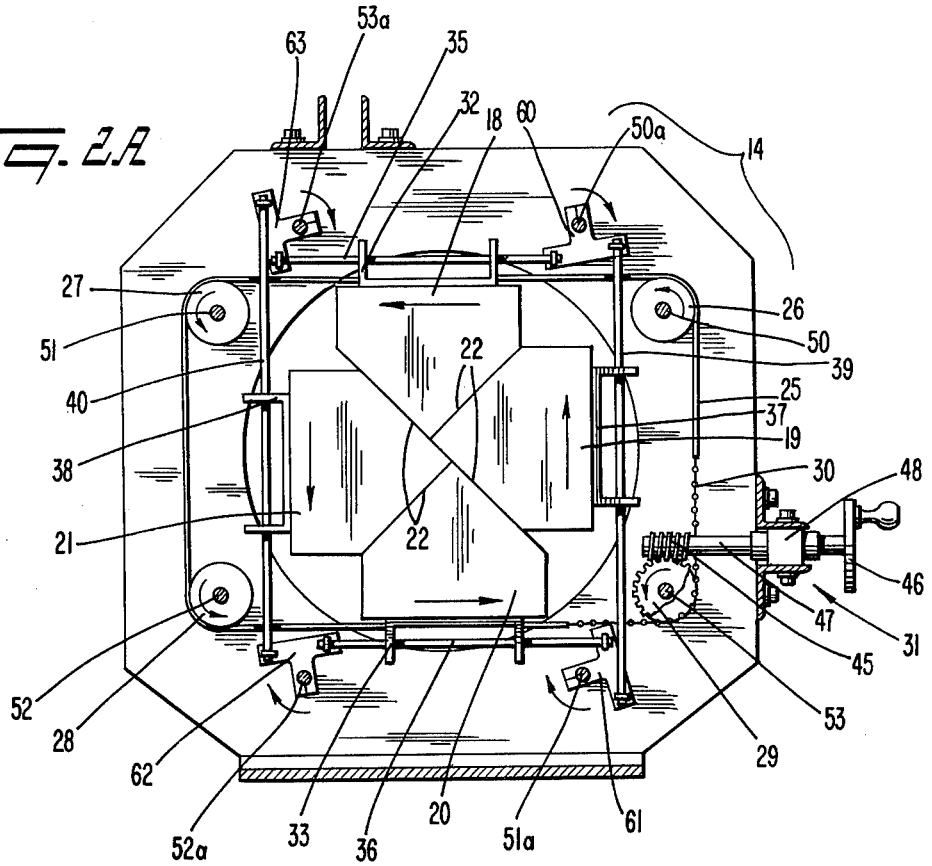
FIGS. 2A and 2B are cross sectional views of the collimator of the invention shown in FIG. 1 with one adjustable block assembly being shown in the closed and open positions, respectively.
Figure 2B:
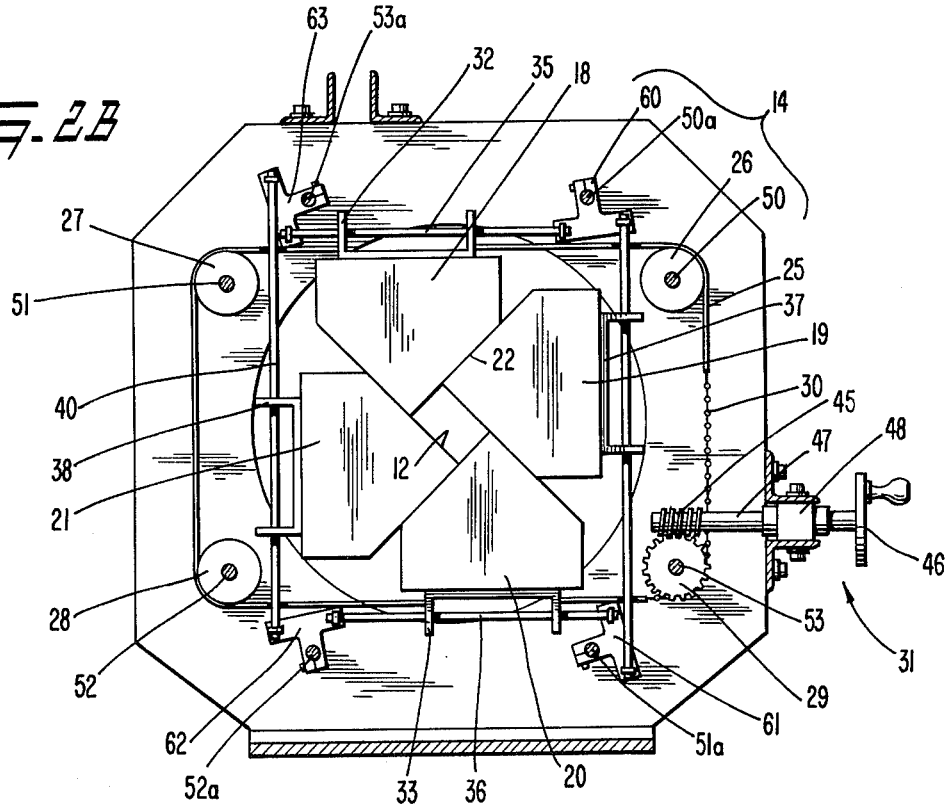
Figure 3A:
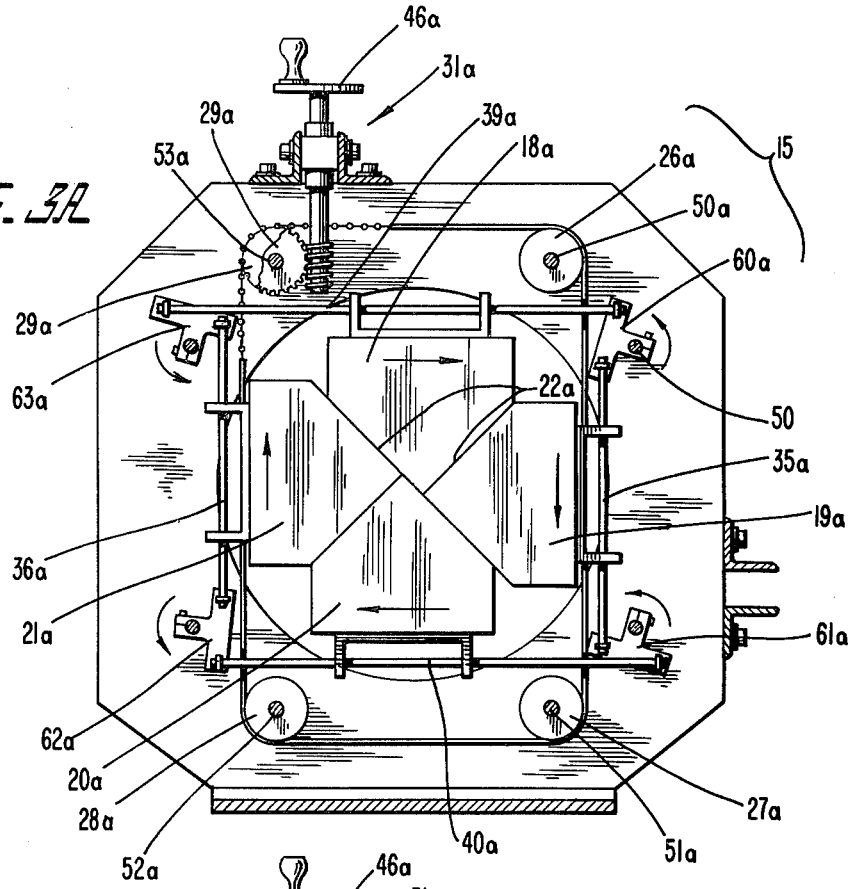
FIGS. 3A and 3B are additional cross sectional views of the collimator of the invention shown in FIG. 1 with an alternate assembly adjacent the block assembly of FIGS. 2A and 2B in the closed and open positions, respectively.

Referring to FIGS. 2A and 2B, a plurality of opaque blocks 18, 19, 20 and 21 are illustrated forming assembly 14. The blocks have adjacent edges 22 in interfacial contact. When in the closed position, as shown in FIGS. 2A, the blocks form a completely beam opaque structure. To form the aperture 12, as shown in FIG. 2B, the blocks 18–21 slide relative to one another along the edge interfaces 22. A mechanism is provided for advantageously adjusting the blocks to slid the blocks to create aperture 12.

To best explain the adjustment means for sliding the blocks 18–21 to provide the aperture 12, reference is made to the block assembly 14 shown in FIGS. 2A, 2B; it being understood that the adjustment means in the block assemblies 15–17 are substantially the same. In particular, an endless cable 25 is trained around corner pulleys 26, 27, 28 and a drive gear 29. The drive gear meshes with a perforated belt section 30 to insure non-slip driving in response to operation of the hand wheel assembly, generally designated by the reference numeral 31 (see FIG. 2A). The cable is attached in the preferred embodiment to slide brackets 32, 33 attached to the opposite blocks 18, 20. Thus as the drive gear 29 is rotated in the direction of the arrow shown in FIG. 2A, the cable 25 moves and in turn the blocks 18–20 move in the direction of the arrows shown also. The mechanical pressure at the edge interfaces 22 in turn move the blocks 19, 21, also as shown by the arrows.

The movement of the blocks 18–21 results in opening of the aperture 12, as shown in FIG. 2B. The configuration of the aperture 12 is assured by the guiding influence of guide rods 35, 36 engaging corresponding apertures in the upstanding legs of slide brackets 32, 33 (compare FIGS. 2A and 2B). Similarly, follower blocks 19, 21 are provided with slide brackets 37, 38, respectively and guided by additional guide rods 39, 40, respectively. The edge interfaces 22 in combination with the guide rods 35, 36 and 39, 40 advantageously insure easy and efficient sliding of the blocks for opening and closing. As will be seen in detail later, the rods are bodily movable toward and away from the center of the array of blocks 18–21 in a unique manner to control the shape of the aperture.

It is clear that the drive gear 29 can be actuated in a number of well known ways. Preferably, the assembly 31 includes a worm gear 35 engaging the outer peripheral teeth of the drive gear 29 and a hand wheel 46 for turning shaft 47 of the worm gear. The shaft is suitably rotatably mounted by bearing assembly 48 (see FIG. 2A).

The pulleys 26–28 and the drive gear 29 are rotatably mounted on four shafts 50–53, respectively. (See FIG. 1 also). In other words, the pulleys and the gear 29 rotate independently of the corresponding shafts upon which they are rotatably mounted. The ends of the shafts 50–53 are suitably journaled in frame plates $F_1$, $F_2$.

The operation of a single array of blocks, such as block assembly 14 in order to form the aperture 12 can now be clearly seen. The blocks 18–21 are initially set or closed in FIG. 2A and upon rotation of the hand wheel 46 the cable 25 is moved providing movement to the blocks 18, 20, that is shifting in the direction of the arrows and guided by the rods 35, 36 respectively. Because of the sliding pressure against the two adjacent blocks 19, 21, these blocks are also moved in accordance with the arrows of FIG. 2A and guided along the corresponding rods 39, 40. As a result, the aperture 12 is created.

Figure 3B:
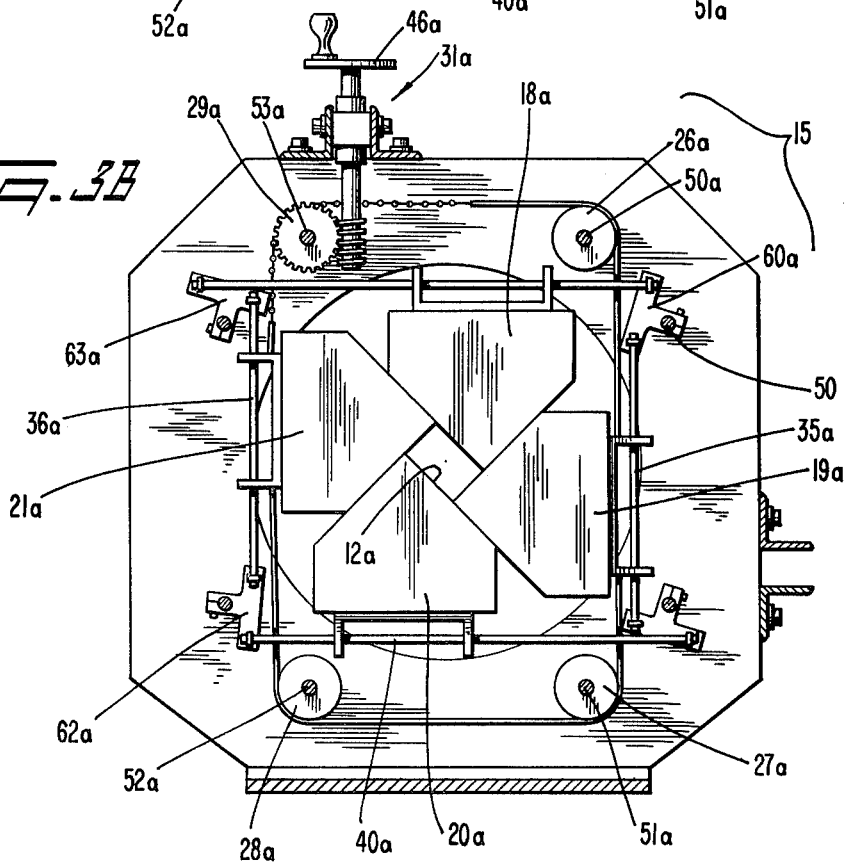

Similarly, in the alternate block assembly 15, wherein like parts are indicated by the same reference numeral but with the suffix a for further identification, the aperture **12*a* can be generated by moving blocks 18*a*–21*a*. Of significance, it will be noted that the entire assembly 15 is inverted front-to-back about axis A with respect to the assembly 14 previously described. Furthermore, the adjustment wheel assembly 31*a* is positioned not only at 90° from the wheel assembly 31 but also so as to provide movement to the blocks 18*a*–21*a* in the opposite direction, as shown by the arrows in FIG. 3A. In other words, the blocks 18*a*–21*a* move in a clockwise direction, as viewed in FIG. 3A whereas the blocks 18–21 move in the counter clockwise direction as viewed in FIG. 2A. This is of importance since it assures the relative movement of sliding interfaces 22*a* in the opposite direction to the sliding interfaces 22. Thus as the aperture 12*a* is opened (see FIG. 3B) none of the sliding interfaces are congruent. In other words, the sliding interfaces 22, 22*a* do not overlie each other and accordingly maximum efficiency of sealing against stray neutron beams is assured. This non-congruency is repeated in block assemblies 16, 17, as best shown in FIG. 5 of the drawings. In each position where a sliding interface 22, 22*a*** is provided, on the adjacent block assembly there is a solid block to block any possible leakage of radiation.

As mentioned above, the adjustment means of the adjacent block assemblies, such as assemblies 14, 15 are inverted with respect to each other and this is accomplished by simply providing four additional shafts supported by the frame members $F_1$, $F_2$. The shafts have been designated **50*a*–53*a* (see FIG. 3A) supporting in turn pulleys 26*a*–28*a* and drive gear 29*a*. The relationship of this orientation can be best comprehended viewing the perspective in FIG. 1. The components for the adjustment means in the block assembly 16 are numbered, and are the same as those shown in assembly 14; and likewise the components in assembly 17 are like those shown in assembly 15**.

While four assemblies 14–17 are shown in the preferred embodiment, it is readily apparent that one assembly 14 could be used as a collimator in accordance with the principles of the present invention. Adding a second block assembly, such as block assembly 15 in back of the block assembly 14, as shown in FIG. 5, provides an additional aperture **12*a* to regulate the neutron beam B or the like. Furthermore, a third assembly, such as block assembly 16 can be put behind the assembly 15 to provide additional collimation; and the additional assembly 17 can be added if desired. Of course, any additional number of block assemblies may be added as required in order to provide the necessary beam opaque structure desired when utilizing the device as a beam collimator, such as for the neutron source 11**. Also, the particular thickness shown for the blocks is for purposes of illustration and it should be understood that the blocks can be wider (indeed up to face-to-face contact) or narrower as desired.

As mentioned above, the guide rods 35, 36 and 39, 40 may be simultaneously moved toward and away from the center of the block assemblies. This movement of the rods is generated by moving means including T shaped intermediate actuators 60–63 (see FIG. 2A). As shown, the adjacent ends of the rods are pivotally mounted on the actuators and the actuators are fixedly attached to the shafts supporting the pulleys. For example, the actuators 60–63 for the assembly 14 are mounted on shafts **50*a*–53*a*. In FIGS. 1 and 2A, it can be seen that actuator 60 is clamped on to shaft 50*a*. Similarly, the actuator 60*a* (see FIG. 3A also) is clamped on shaft 50. In turn, shafts 50, 50*a* include large drive pinions 70, 70*a* fixed to the shafts on the outside of frame $F_1$. A worm gear 71 meshes with the two pinions 70, 70*a* and is a part of the moving wheel assembly, generally designated by the reference numeral 72 (FIG. 1). Since the pinions 70, 70*a* engage opposite sides of the worm 71 it will be realized that the shafts 50, 50*a*** may be rotated in opposite directions giving the desired opposite movement described with respect to the blocks in FIGS. 2A and 3A.

The advantageous result of movement of all of the guide rods 35, 36, 39, 40 and **35*a*, 36*a*, 39*a*, 40*a* is that the shape of the apertures 12, 12*a* can be varied in shape and the variation can be accomplished in unison. For example, in the preferred embodiment the apexes of the blocks 18–21 are offset or skewed, as shown in FIG. 2A. This is accomplished by moving the guide rods as shown by the rotational arrows adjacent the actuators 60–63. In particular, blocks 18, 20 are moved away from each other and blocks 19, 21 are moved toward each other providing the offset or skewing at the apexes. Thus, when the aperture 12 is generated or opened, as shown in FIG. 2B, the sliding movement caused by the cable 25 creates a non-equilateral or in this case a rectangular opening, as desired. When the aperture 12 is closed, the blocks return to the offset or skewed position with the interfaces 22** sealed, as shown in FIG. 2A.

The alternate block assemblies, such as block assembly 15 act in the same manner and the offsetting or skewing action is generated concurrently, since as it will be remembered the pinions 70, 70*a* are simultaneously rotated by the moving wheel assembly 72. Thus in FIG. 3A, the blocks 19*a*, 21*a* are moved toward each other by bodily translation of the guide rods 39*a*, 40*a* whereas the blocks 18*a*, 20*a* are moved away from each other by an equal amount by movement of guide rods 35*a*, 36*a* (note movement arrows in FIG. 3A). It will also be noted that the aperture 12*a* is congruent with the aperture 12 and remains so in all adjusted positions of the blocks.

Figure 4A:
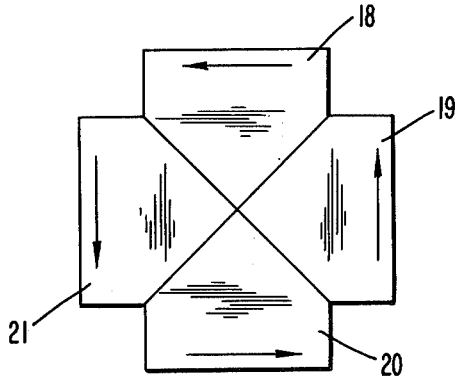
FIGS. 4A and 4B are schematic frontal views of four blocks of a block assembly in the closed and open positions, respectively, and adjusted to provide an equilateral aperture.
Figure 4B:
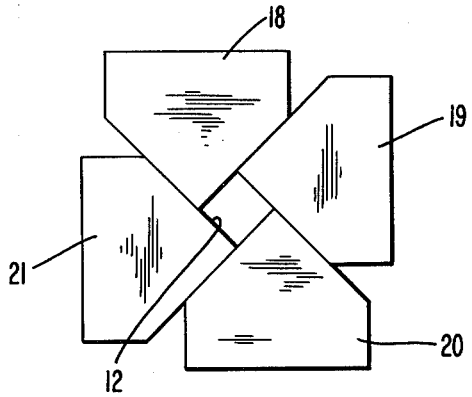

As shown in FIGS. 4A and 4B, the movement of the actuators to shift the guide rods in the direction opposite to that described above allows alignment of the apexes of the blocks 18–21 (FIG. 4A) and then upon actuation of the blocks by the adjustment wheel assembly 31 the aperture 12 formed is square rather than rectangular. It will thus be realized that by a simple adjustment of the rods in unison a desired configuration of each of the apertures 12, 12*a* can be effected and thus the area for the channel accommodating the beam B is advantageously varied. Also, it will be recognized that where a different number of blocks are used, as indicated above, a different shape of the aperture 12, 12*a* does result. For example, if three blocks are used, a triangular aperture results; if five blocks are used in an array, then the aperture is a pentagon; and so forth for additional configurations. However, the apparatus of the present invention is such that regardless of the shape of the aperture the apertures of the assemblies remain congruent and thus form a beam channel when set up as shown in FIG. 5.

Figure 6:
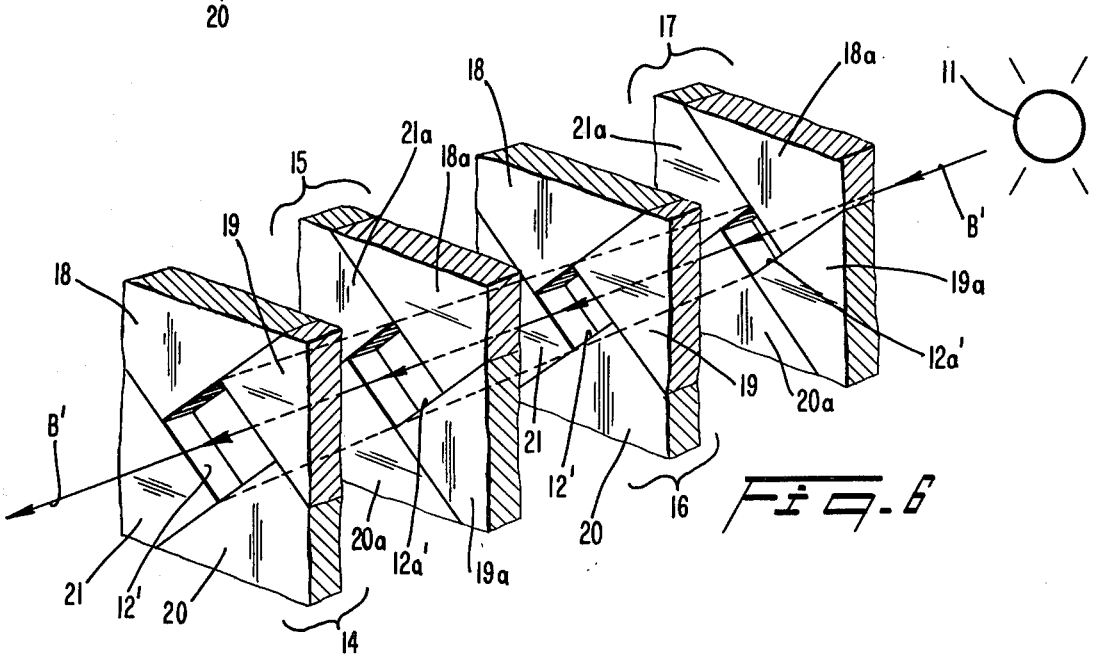
FIG. 6 is a schematic, perspective view of the blocks of the multiple block collimator illustrating a diverging beam channel.

In accordance with another aspect of the present invention, the assemblies 14–17 can be adjusted separately by simply moving the hand wheels of the adjustment wheel assemblies 31, 31*a* a different amount. Thus in the embodiment of FIG. 6, the adjustment wheel 46 is opened to provide an aperture 12' of a particular size. The aperture 12*a'* of the blocks in the adjacent assembly 15 is turned a lesser amount providing a smaller aperture 12*a'*. Similarly, the adjustment assembly of block assembly 16 is opened a lesser amount and the adjustment assembly in the block assembly 17 is opened still less to provide a diverging channel allowing the passage of the beam B'. The beam is thus a diverging beam that can be rectangular as shown, or could be diverging and square if the adjustment of FIGS. 4A, 4B is used. When the diverging channel is to be closed to cut off the beam B' each of the individual adjustment assemblies is simply moved in the reverse direction thus moving the blocks and closing each of the apertures in turn, as described above.

In view of the foregoing, it will now be realized that substantial results and advantages over the prior art collimators is provided. The beam opaque blocks 18–21 are capable of efficient opening and closing through the individual adjustment assemblies 14–17. The blocks move along the sliding interface 22 so as to provide a barrier that is tight except for the aperture 12 and with no overlapping surfaces. When closed, the blocks converge at the apexes in the center of the block assembly.

The adjustment for creating the variable apertures is provided by a novel cable drive engaging brackets attached to at least one of the sliding blocks. The mechanical pressure on the follower blocks provides the desired opening in a controlled fashion. Guide rods extending through the brackets ensure proper movement of the blocks and the guide rods may be translated toward and away from each other in order to adjust the shape of the apertures. When multiple block assemblies are utilized, a beam channel, including a diverging channel if desired, can be provided in an efficient manner.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize in the invention in various embodiments and with various modifications as are suited to the particular use contemplated. It is intended that the scope of the invention be defined by the claims appended hereto.

I claim:

1. A variable aperture energy beam collimator apparatus comprising:

a frame member having a central aperture therethrough;

a block assembly which includes a plurality of beam-opaque blocks and variable aperture adjustment means, said adjustment means comprising guide means carried by the frame member and including an individual guide member for slidably carrying each block, each said block having interfacing edges in sliding contact with adjacent blocks and forming a completely beam-opaque surface when in a closed position; and a first operator member carried by the frame member and first linkage means operably connected between the first operator member and the block assembly for simultaneously sliding all of the blocks along their respective guide members with respect to each other while maintaining the sliding interfaces in contact for providing an aperture of desired size.

2. A variable aperture beam collimator as described in claim 1 wherein said blocks converge at apexes adjacent the center of said block assembly, said block assembly including n-blocks where n is greater than two and the apex angle of each block being 360/n degrees and where the guide member for each block is aligned perpendicular to a line bisecting the apex angle thereof.

3. A variable aperture beam collimator as described in claim 2 wherein said blocks are four in number.

4. A variable aperture beam collimator as described in claim 2 wherein each guide member comprises a guide rod and each block member is provided with a slide bracket for guiding the blocks therealong, said linkage means comprising an elongated cable connected between at least one slide bracket and the operator member and including cooperating support pulleys such that rotation of the operator member imparts movement to said at least one slide bracket and associated block, the interface surfaces of said block imparting motion to the other blocks forcing the other blocks to move along their respective guide rods.

5. A variable aperture beam collimator as described in claim 4 and including means for selectively translating said guide rods with respect to the frame member to provide a change in shape of said variable aperture.

6. A variable aperture beam collimator as described in claim 5 wherein said means for translating said guide rods comprises a plurality of pivotal actuators connecting the adjacent ends of the guide rods, a second operator member carried by the frame member and second linkage means operably connected between the actuators and the second operator members such that rotation of the second operator member imparts pivotal movement to all of the actuators simultaneously such that the blocks are skewed from one another in the closed position and provide a nonequalateral aperture in the open position.

7. A variable aperture beam collimator as described in claim 1, further comprising:

a second in-line block assembly;

second variable aperture adjustment means for adjusting said second block assembly thereby defining a second aperture, said second aperture being in congruent alignment with the first aperture to define a beam confining channel;

said second block assembly and adjustment means being inverted front-to-back with respect to the first block assembly and first aperture adjustment means, whereby the contacting edge interfaces of said opaque blocks of said second block assembly are not in alignment with the contacting edge interfaces of said opaque blocks of the first block assembly so as to prevent energy leakage from emerging from the collimator apparatus.

8. A variable aperture beam collimator as described in claim 7 wherein said first and second block assemblies are adjusted unequally providing unequal size first and second apertures providing a divergent beam confining channel.

9. A variable aperture beam collimator as described in claim 1 wherein is included:

a second in-line block assembly;

second variable aperture adjustment means for adjusting said second block assembly thereby defining a second aperture, said second aperture being in congruent alignment with the first aperture to define a beam confining channel;

said seccond block assembly and adjustment means being inverted front-to-back with respect to the first block assembly and first aperture adjustment means, wherein the contacting edge interfaces of said opaque blocks of said second block assembly are not in alignment with the contacting edge interfaces of said opaque blocks of the first block assembly so as to prevent energy leakage from emerging from the collimator apparatus.

10. A variable aperture beam collimator as described in claim 9 and including means for translating the guide members of each block assembly said means for translating comprising a pinion member operably connected to each block assembly and a worm gear mounted between said pinions for simultaneously translating the guide members of each block assembly in opposite directions, wherein the edge interfaces of each of the block assemblies are noncongruent.

* * * * *